United States Patent [19]

Allou, Jr. et al.

[11] Patent Number: 4,816,336

[45] Date of Patent: Mar. 28, 1989

[54] SYNTHETIC FIBER HAVING HIGH NEUTRALIZED ALKYL PHOSPHATE ESTER FINISH LEVEL

[75] Inventors: Anthony L. Allou, Jr., Inman; Roland L. Hawkins, Spartanburg, both of S.C.

[73] Assignee: Hoechst Celanese Corporation, Somerville, N.J.

[21] Appl. No.: 34,130

[22] Filed: Apr. 2, 1987

Related U.S. Application Data

[63] Continuation of Ser. No. 848,638, Apr. 4, 1986, abandoned.

[51] Int. Cl.[4] ..... D02G 3/00

[52] U.S. Cl. ..... 428/361; 252/8.6; 252/8.75; 252/8.9; 428/394; 428/395

[58] Field of Search ..... 428/361, 375, 394, 395; 252/8.6, 8.75, 8.9

[56] References Cited

U.S. PATENT DOCUMENTS

| | | | |
|---|---|---|---|
| 1,970,578 | 8/1934 | Schoeller et al. | 260/98 |
| 2,213,477 | 9/1940 | Steindorff et al. | 260/613 |
| 2,668,785 | 2/1954 | Jefferson et al. | 117/139.5 |
| 3,113,369 | 12/1983 | Barrett et al. | 28/75 |
| 3,113,956 | 12/1963 | Robinette | 260/459 |
| 3,242,074 | 3/1966 | Donaldson et al. | 252/8.75 |
| 3,245,905 | 4/1966 | White et al. | 252/8.75 |
| 3,306,850 | 2/1967 | Olsen | 252/8.7 |
| 3,341,343 | 9/1967 | Beiswanger et al. | 106/177 |
| 3,341,451 | 9/1967 | Dziuba et al. | 252/8.6 |
| 3,503,880 | 3/1970 | McMicken | 252/8.75 |
| 3,505,220 | 4/1970 | Blake et al. | 252/8.6 |
| 3,518,184 | 6/1970 | Potter | 252/8.75 |
| 3,519,562 | 7/1970 | Lanner | 252/8.8 |
| 3,544,462 | 12/1970 | Finch et al. | 252/8.6 |
| 3,560,382 | 2/1971 | Finich | 252/8.9 |
| 3,563,892 | 2/1971 | Cooley | 252/8.7 |
| 3,634,117 | 1/1972 | Wegerhoff et al. | 117/138.8 F |
| 3,704,225 | 11/1972 | Shay | 252/8.9 |
| 3,719,587 | 3/1973 | Wegerhoff et al. | 252/8.8 |
| 3,855,776 | 12/1974 | Omura et al. | 57/153 |
| 3,859,122 | 1/1975 | Burks, Jr. | 117/138.8 F |
| 3,868,270 | 2/1975 | Proffitt, Jr. | 117/139.5 |
| 3,951,825 | 4/1976 | Carver | 252/8.7 |
| 3,997,450 | 12/1976 | Steinmiller | 252/8.7 |
| 4,051,299 | 9/1977 | Steinmiller | 428/394 |
| 4,080,301 | 3/1978 | Kleber et al. | 252/8.6 |
| 4,098,741 | 7/1978 | Login | 260/29.2 E |
| 4,105,568 | 8/1978 | Marshall et al. | 252/8.6 |
| 4,169,061 | 9/1979 | Carver et al. | 252/8.9 |
| 4,169,062 | 9/1979 | Weipert | 252/8.9 |
| 4,242,095 | 12/1980 | Carver | 8/115.6 |
| 4,294,883 | 10/1981 | Hawkins | 428/361 |
| 4,296,165 | 10/1981 | Kakar et al. | 428/264 |

OTHER PUBLICATIONS

Billica, "Update on Fiber Finishes: What's Happening Now? Why?", *Fiber Producer* 21 (Apr. 1984).

Billica, "Fiber Finishes Formulation and Evaluation", *Fiber Producer* 24 (Jun. 1984).

*Primary Examiner*—Lorraine T. Kendell

*Attorney, Agent, or Firm*—Forrest D. Stine

[57] ABSTRACT

A two-component staple fiber finish is disclosed which renders polyester staple fiber having low to normal modulus and tenacity-at-break fit for "100%" open end spinning. A synthetic fiber having from about 0.08 to about 0.15 weight percent, based on the total weight of the fiber, of a primary finish comprising (a) from 25 to 85 weight percent of at least one alkyl phosphate ester salt, and (b) from 15 to 75 weight percent of a second component selected from the group consisting of quaternary trialkyl ethyl ammonium ethosulfate salts and the reaction products of polyoxyethylene ethers and $C_8$–$C_{22}$ fatty acids is claimed.

The use of a secondary lubricant to enhance the carding and drawing characteristics of the staple fiber is also disclosed.

12 Claims, No Drawings

SYNTHETIC FIBER HAVING HIGH NEUTRALIZED ALKYL PHOSPHATE ESTER FINISH LEVEL

This is a continuation of application Ser. No. 848,368, filed on Apr. 4, 1986, now abandoned.

BACKGROUND OF THE INVENTION

The present invention relates to a synthetic staple fiber which permits "100 percent" open end spinning of polyester fiber at high processing speeds. More particularly, the present invention relates to a synthetic fiber having from about 0.08 to about 0.15 weight percent, based on the total weight of the coated fiber, of a primary finish comprising at least one alkyl phosphate ester salt in combination with a second component selected from the group consisting of quaternary trialkyl ethyl ammonium ethosulfate salts and the polyoxyethylene ether esters of $C_8$–$C_{22}$ fatty acids.

As is well known in the textile arts, the manufacture and subsequent processing of synthetic fibers requires the application of a fiber processing aid (typically termed a "fiber finish" or "finish"). Such fiber finishes are typically aqueous emulsions or solutions comprised of two major constituents, which function as a lubricant and as an artistat, respectively. Depending on the chemical identities of the lubricant and the antistat, an emulsifier may be required as a third major component. Optional or auxiliary constituents include pH control agents, antioxidants, viscosity modifiers, wetting agents, bacteriocides, and anticorrosive agents.

The salts of alkyl phosphate esters have long been recognized as effective antistatic agents in polyester yarn finishes. Generally, the concentration of these alkyl phosphate ester salts does not exceed twenty five percent of the total weight of the finish composition. See, for example, U.S. Pat. No. 3,341,451, which claims a textile processing agent comprising from 5 to 25 percent of a potassium alkyl phosphate ester in which the alkyl radical has from 6 to 10 carbon atoms, from 50 to 90 percent of an organic liquid such as white mineral oil, and from 5 to 25 percent of a blending agent.

The use of greater than 25 weight percent of an anionic antistat in a fiber finish composition typically results in excessive lapping of the rollers on the drawing frame.

Similarly, quaternary trialkyl ethyl ammonium ethosulfate salts have long been recognized as effective antistatic agents in textile fiber finishes. See, for example, U.S. Pat. No. 3,113,956, which discloses the preparation of such salts by heating stoichiometric quantities of a trialkylamine having a long chain alkyl and two short chain alkyl groups with diethyl sulfate in the presence of from 2 to 15 percent triethanolamine.

While these and various other compounds have been proven effective in reducing the static electricity generated by the ever-increasing processing speeds sought by synthetic fiber manufacturers and processors, the advent of "open end spinning" in staple fiber processing created a heretofore unsatisfied need for a superior synthetic staple fiber which not only exhibits superior lubrication and reduction of static electricity, but also permits "100% open end" spinning of polyester staple fiber.

The classical ring spinning method by which discrete staple fibers are manufactured into continuous spun yarn is well-known and may be summarized as sequentially comprising the steps of (i) opening the baled, compact staple fiber by means of a "picker" machine, thereby forming loose clumps of staple fiber which are subsequently compressed into a loose batting called a "picker lap";

(ii) combing ("carding") the lap so that the discrete staple fibers are substantially parallelized and forming these parallelized staple fibers into a loose continuous strand called a "card sliver";

(iii) combining a plurality of card slivers into a single, more even strand called "drawn sliver" in which the individual staple fibers are drawn into a more parallel relationship by means of a drawing frame;

(iv) further drawing one or several combined drawn sliver strands into a single continuous threadline, termed a "roving", having a minor amount of tensile strength by means of a "roving" machine which imparts twist to the threadline;

(v) drawing and further twisting the roving on a ring spinning machine to produce a "spun yarn".

In the 1970's high speed "open end" spinning machines were commercially introduced which converted "drawn sliver" into spun yarn in a single step, thereby eliminating the need for separate "roving" and "ring spinning" machines. The open end spinning machines offer the advantage of approximately eight fold higher processing speeds than conventional ring spinning machines.

The advantages of open end spinning have been realized in those applications where 100% cotton, blends of polyester and cotton, 100% acrylic, or 100% nylon have been utilized. However, there are several areas where "100% polyester" rather than blends of cotton and polyester are preferred due to the superior toughness, strength and ease of care properties of polyester fiber.

Unfortunately, textile manufacturers have been unable to fully utilize the inherent advantages of open end spinning in the manufacture of "100% polyester" yarns of relatively low modulus and tenacity-at-break. When an open end spinning machine is operated at its normal production speed with 100% polyester sliver, the resultant yarn tends to break frequently, thereby interrupting the continuous operation of the machine. In practice, textile manufacturers have had to operate their open end spinning machines at significantly lower speeds when making such "100% polyester" yarn to avoid the problem of excessive yarn breakage, known as "ends down".

The inventors are aware of few polyester yarns which can be processed at normal speeds on open end spinning machines at an acceptably low ends down. These few yarns uniformly display high modulus and high tenacity-at-break properties, which are not desirable for all textile applications.

The textile manufacturer is faced with other processing considerations in addition to yarn breakage at the open end spinning machines. These include the minimization of static electricity, especially in high speed carding machines. The staple fiber sliver must be capable of running through a drawing frame without adhering to the sets of rollers which form the nips through which the sliver is drawn. Finally, the staple fiber must not leave fiber fragments ("fly") or finish deposits on the working surfaces of the open end spinning machine.

The problem confronting fiber manufacturers is to develop a staple fiber finish which not only permits high speed operation of open end spinning machines when employing 100% polyester of relatively low modulus and tenacity-at-break, but also exhibits acceptable carding and drawing characteristics.

The present invention provides a staple fiber having relatively low modulus and tenacity-at-break which permits acceptable high speed operation of open end spinning machines when processing "100% polyester" sliver, and which also exhibits acceptable carding and drawing characteristics. A solution to the problem of "excessive ends down", which has bedeviled textile manufacturers for over a decade, has finally been provided by the instant invention.

SUMMARY OF THE INVENTION

In one aspect, the present invention relates to a synthetic fiber having from about 0.08 to about 0.15 weight percent, based on the total weight of the coated fiber, of a primary finish comprising (a) from 25 to 85 weight percent of at least one alkyl phosphate ester salt, and (b) from 15 to 75 weight percent of second component selected from the group consisting of quaternary trialkyl ethyl ammonium ethosulfate salts and the reaction products of polyoxyethylene ethers and $C_8$ to $C_{22}$ fatty acids. with the proviso that said staple fiber possess an "ends down"/1000 spindle hours of open end spinning at a rotor speed of 50,000 rpm of 100 or less.

In another aspect, the present invention relates to a synthetic staple fiber, suitable for open end spinning, having (a) from about 0.08 to about 0.15 of a primary finish comprising (i) from 25 to 85 weight percent of at least one alkyl phosphate ester salt, and (ii) from 15 to 75 weight percent of a second component selected from the group consisting of quaternary trialkyl ethyl ammonium ethosulfate salts and the reaction products of polyoxyethylene ethers and $C_8$ to $C_{22}$ fatty acids, and (b) from 0.01 to 0.06 weight percent of a secondary lubricant, with the proviso that said staple fibers possess an "ends down"/1000 spindle hours of open end spinning at a rotor speed of 50,000 rpm of 100 or less.

In still another aspect, the present invention relates to a process for open end spinning of staple polyester yarn comprising (A) applying to a polyester yarn, (i) from about 0.08 to about 0.15 percent of a primary finish comprising (a) from 25 to 85 weight percent of at least one alkyl phosphate ester salt; and (b) from 25 to 85 weight percent of second component selected from the group consisting of quaternary trialkyl ethyl ammonium ethosulfate salts and the reaction products of polyoxyethylene ethers and $C_8$–$C_{22}$ fatty acids, (ii) from 0.01 to 0.06 weight percent of a secondary lubricant, said polyester yarn having a tenacity-at-break of from 3.0 to 6.0 gram-force/denier and a modulus of from 10 to 30 gram-force/denier, either prior to or after said yarn is cut into staple, (B) carding said staple fiber into card sliver;

(C) drawing said fiber into drawn sliver;

(D) spinning said drawn sliver into thread by means of an open end spinning machine, with the proviso that said drawn sliver possess an "ends down"/1000 spindle hours of open end spinning at a rotor speed of 50,000 rpm of 100 or less.

DETAILED DESCRIPTION OF THE INVENTION

The inventors have discovered that alkyl phosphate ester salts, as defined herein, can impart lubrication as well as antistatic properties to staple polyester fibers. The enhanced lubricity provided by the alkyl phosphate ester salts is evident only at relatively high (at least 25 weight percent) concentration levels on the fiber, compared to concentration levels which are typical for antistat components of fiber finish compositions (generally 10 to 15 weight percent).

The relatively high level of alkyl phosphate ester salt on the fiber surface reduces the fiber-to-fiber friction while increasing fiber-to-metal friction. The increased fiber-to-metal friction may be reduced by the application of a secondary lubricant, which should provide sufficient lubricity to improve carding and drawing, without significantly affecting fiber-to-fiber friction.

When combined with a second component into a fiber finish composition the alkyl phosphate ester salts can impart commercially acceptable open end spinning as well as facilitate commercially acceptable carding and drawing of 100% polyester staple fiber, even to staple fiber having relatively low modulus and tenacity-at-break.

A. Alkyl Phosphate Ester Salt

As used herein, the term "alkyl phosphate ester" means the monoesters, diesters, and triesters conforming to formulae I, II, or III:

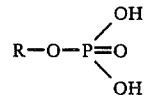
(I)

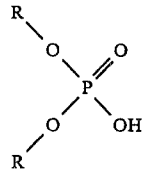
(II)

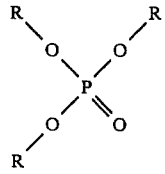
(III)

where "R" is defined as straight or branched, saturated or unsaturated alkyl radicals of from 6 to 22 carbon atoms; and mixtures of such esters.

These alkyl phosphate esters may be prepared from their corresponding alkanols by several techniques. While substantially pure alkanols may be employed, mixtures of alkanols are also effective and more economical. A blend of $C_8$–$C_{16}$ or $C_8$–$C_{10}$ alkanols is preferred. A mixture of primarily monesters and diesters, as opposed to the triester, may be prepared by reacting the chosen alkanol or blend of alkanols with phosphorous pentoxide. To assure complete conversion of the alkanol into the corresponding phosphate ester, it is preferable to employ an excess of phosphorous pentoxide. The excess phosphorous pentoxide may be subsequently reacted by the addition of a small amount of a polyol such as a glycerol. This synthesis produces about 60 to 70% diester with the remainder being the monoester.

An alternative synthesis route, which produces primarily diesters and triesters (illustrated below), comprises reacting phosphorous oxychloride with the alkanols:

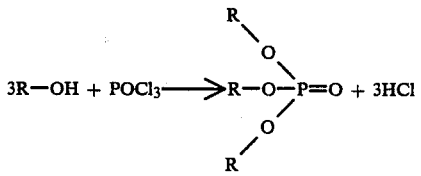

The "alkyl phosphate ester salt" of the present invention is formed by reacting the monoalkyl phosphate esters or the dialkyl phosphate esters, or more usually mixtures of these esters which may also include trialkyl phosphate esters, with a base such as potassium hydroxide, sodium hydroxide, or triethanolamine. Potassium hydroxide is preferred.

The alkyl phosphate ester salt may be applied to the synthetic fiber as an aqueous solution or emulsion. The fiber may be subsequently heated to evaporate the water, leaving the alkyl phosphate ester salt.

B. The Second Component

The second component of the primary finish composition of the present invention may be either a quaternary trialkyl ethyl ammonium ethosulfate salt or a polyoxyethylene ether which has been reacted with at least one fatty acid.

1. Quaternary Trialkyl Ethyl Ammonium Ethosulfate Salt

As disclosed above, quaternary trialkyl ethyl ammonium ethosulfate salts have long been recognized as effective antistats in fiber finish compositions. The ethosulfate salts believed effective in the present invention are derived from tertiary amines which possess a long chain alkyl group of from 8 to 22 carbon atoms and two short chain alkyl groups of from 1 to 4 carbon atoms. The longer alkyl component may be derived from pure compounds or mixtures of long chain alkyl compounds such as mixtures of fat and oil acids, and may be straight chain, branched, saturated or unsaturated.

Specific ethosulfate salts which may be employed as the second component in the primary fiber finish of the present invention include soya dimethyl ethyl ammonium ethosulfate, lauryl dimethyl ethyl ammonium ethosulfate, and cetyl dimethyl ethyl ammonium ethosulfate.

These ethosulfate salts may be prepared by traction of the appropriate monolong chain dishort chain tertiary amine with a stoichiometric amount of diethyl sulfate in the presence of a trialkanolamine, such as triethanolamine. For example, soya dimethyl ethyl ammonium ethosulfate may be prepared by reacting dimethylsoya amine with diethyl sulfate under agitation at a temperature of from 195° to 220° F.

Further details on the preparation and properties of quaternary trialkyl ethyl ammonium ethosulfate salts are disclosed in U.S. Pat. No. 3,113,956, the disclosure of which is expressly incorporated by reference in its entirety.

2. Polyoxyethylene Ether Fatty Acid Ester

In addition to the quaternary trialkyl ammonium ethosulfate salts disclosed above, the second component of the fiber finish of the present invention may be a polyoxyethylene ether which has been reacted with at least one $C_8$–$C_{22}$ fatty acid (hereinafter referred to as "polyethers").

Such polyethers are typically prepared by reaction of a large molar excess of ethylene oxide with at least one fatty acid, which will produce a reaction mixture comprising several polyethers of different molecular weight. For example, one of the preferred polyethers is the reaction product of 10 moles of ethylene oxide with one mole of a 50/50 blend of oleic and pelargonic acids, which results in a mixture of polyethers whose degree of polymerization may range from 8 to 12, with the two predominant products being $$CH_3(CH_2)_7-\overset{\overset{\displaystyle O}{\|}}{C}-O(CH_2CH_2-O)_{10}-H \text{ and}$$

$$CH_3(CH_2)_7-CH=CH-(CH_2)_7-\overset{\overset{\displaystyle O}{\|}}{C}-O\leftarrow CH_2CH_2O)_{10}H$$

Such a polyether may often be referred to as "POE (10) on a 50/50 blend of oleic and pelargonic acid" with the number in parentheses indicating the molar excess of ethylene oxide employed.

It should be noted that purified grades of the alkyl carboxylic acids are not required by the present invention. The "technical grade" of oleic acid contains significant amounts of linoleic acid and palmitic acid, together with minor amounts of myristic and linolenic acids. Similarly, the "technical grade" of pelargonic acid contains other acids. The presence of these other carboxylic acids does not render the oleic/pelargonic blend unfit for use in the present invention.

C. Manufacture of Staple Fiber

There are several generic manufacturing processes which may be employed in the production of staple synthetic fibers, including "melt spinning", "wet spinning", and "dry spinning". These three manufacturing processes differ from one another by the extrusion method they employ. As disclosed in the published literature, many specific variants of each of the three generic processes have been developed. However, all of these processes have in common the assembly of fiber bundles comprising many thousands of filaments, subsequently followed by cutting these into relatively short lengths called "staple fibers". Clumps of the cut staple fiber, of varying size and density, fall out of the cutting apparatus, either directly into a baler or into a transfer system which conveys them to a baler.

A tyical process for the manufacture of polyester staple fibers may be briefly described as follows. Polyester resin, typically in chip form, is melted in an extruder and is pumped via a plurality of metering pumps through a plurality of filter packs, each containing a multiple-hole spinnerette, which forms the molten polyester into a plurality of filament-like forms. The extruded filament-like forms are immediately cooled below the glass transition temperature of the polyester, thereby forming the actual filaments. The "primary" fiber finish composition is applied to the cooled polyester filaments. The filaments from all spinnerettes of the spinning machine are piled to form a spin cable, which is typically collected by deposition into a large can. The spun cables from a plurality of cans are subsequently fed from a creel to a stretch line. The assembly of spin cables on the stretch line (typically termed a "tow band") is typically recoated with the primary fiber finish in a pre-stretch bath, and stretched to orient the filaments. In order to provide cohesion between the fibers necessary for subsequent textile processing, the fiber tow is crimped in a stuffer box, which produces a relatively wide band of crimped fiber called a crimped tow. The crimped tow is heat set, and a secondary finish may be applied to the crimped tow. The tow is cut into staple fiber and baled. Alternatively, in order to produce fiber possessing a higher modulus, the fiber tow may be crimped after being heat-set, then cut into staple fiber and baled.

D. Tenacity-at-Break and Modulus

Tenacity-at-break and modulus are measures of the tensile strength of a staple fiber. "Tenacity" is defined as the tensile stress, expressed as force per unit liner density of an unstrained fiber specimen. "Tenacity-at-break" is the tenacity of the fiber at the breaking load of the fiber specimen, and is typically reported in grams-force/denier. Throughout this specification, the word "tenacity" has been employed as an abbreviation of tenacity-at-break.

"Modulus, Secant" is the ratio of the change in stress to the change in strain between two points on a stress-strain curve. The two points employed by the inventors are zero stress and 10 percent elongation stress. Throughout this specification, "Modulus, Secant" has been abbreviated to "modulus".

Testing methods for tenacity and modulus are contained in ASTM D-2101, "Standard Test Methods for Tensile Properties of Single Man-Made Textile Fibers Taken from Yarns and Tows," the disclosure of which is expressly incorporated by reference.

Polyester yarns typically possess mid to high modulus and tenacity-at-break in comparison to other synthetic fibers such as rayon. For example, the tenacity-at-break of polyester staple yarn typically ranges from 3.0 to 7.0 grams-force/denier. Within this range, a "low tenacity" polyester yarn may have from 3.0 to 4.0 grams-force/denier, a "normal tenacity" yarn may have from 4.0 to 6.0 grams-force/denier, and a "high tenacity" yarn may possess from 6.0 to 7.0 grams-force/-denier.

Similarly, the modulus of polyester staple yarn typically ranges from 12 to 50 grams-force/denier. Within this range, a "low modulus" polyester yarn may have from 12 to 20 grams-force/denier modulus, a "normal modulus" polyester yarn may have from 20 to 30 grams-force/denier modulus, and a "high modulus" polyester yarn may have from 30 to 50 grams-force/denier modulus.

The tenacity and modulus properties of polyester yarn affect the dye acceptance and shrinkage resistance of the yarn. Generally, "high tenacity, high modulus" polyester yarn is difficult to dye and tends to shrink upon exposure to heat and moisture. "Low tenacity, low modulus" polyester yarn, although weaker than "high tenacity, high modulus" yarn, is typically easier to dye and more shrinkage resistant than "high tenacity, high modulus" yarn.

E. Application of the Finish Composition to the Staple Fiber

The finish composition of the present invention may be applied as an aqueous solution or emulsion at various points in the polyester staple fiber manufacturing process described above. The finish composition may be applied as the primary finish (or as part of the primary finish) immediately after cooling the filaments and again prior to stretching, onto the tow just prior to cutting, onto the tow separately as a pre-crimper finish, or by the staple fiber processor by overspraying the staple fiber prior to carding, drawing, and open end spinning. All four methods of application are within the scope of the present invention. The first method of application is preferred.

F. The Secondary Lubricant

The inventors have found that, in addition, it is desirable to apply a secondary lubricant finish to the synthetic fiber in order to facilitate commercially acceptable carding and drawing of polyester staple fiber having from 0.08 to 0.15 percent of the primary finish of the present invention. The secondary lubricant reduces fiber-to-metal friction, thereby facilitating acceptable high speed carding, and also improves the drawing of the staple fibers.

The secondary lubricant may be applied together with the primary finish of the present invention or separately, and by the staple fiber manufacturer or by the staple fiber processor.

The secondary lubricant may be any conventional fiber lubricant. All that is required is the addition of a secondary lubricant to a synthetic fiber which has been coated with from about 0.08 to 0.15 percent, based on the weight of the coated fiber, of the finish composition of the present invention in an amount effective to render the resulting staple fiber capable of commercially acceptable carding and drawing. The following four secondary lubricants have been found effective in the practice of the present invention:

1. a 70/30 weight percent mixture of butyl stearate and an ethoxylated sorbitol ether capped with six moles of oleic acid referred to as "POE (50) sorbitol hexaoleate";

2. A 69/23/8 weight percent mixture of a 50/50 blend of polyoxyethylene ethers capped with oleic acid and pelargonic acid, a blend of n-octyl adipate and n-decyl adipate, and soya dimethyl ethyl ammonium ethosulfate;

3. a 30.5/30.5/29/10 weight percent mixture of a 50/50 blend of polyoxyethylene ethers capped with oleic acid and pelargonic acid, a blend of n-octyl adipate and n-decyl adipate, a polyoxyethylene ether capped with oleic acid on one end and methyl on the other, and soya dimethyl ethyl ammonium ethosulfate;

4. a 50/20/5/25 weight percent mixture of mineral oil (70 Saybolt Universal Seconds), a blend of polyoxyethylene ethers capped on one end with $C_{12}$–$C_{18}$ alkanols, oleic acid, and a 50/50 blend of polyoxyethylene ethers capped with oleic acid and pelargonic acid.

DESCRIPTION OF A PREFERRED EMBODIMENT

A preferred embodiment of the present invention comprises staple fiber which has about 0.10 weight percent of a fiber finish consisting essentially of (a) 25 parts of a blend of polyoxyethylene ethers which have been reacted with a 50/50 blend of oleic acid and pelargonic acid and (b) 75 parts of a potassium salt of the alkyl phosphate esters produced by reacting phosphorous pentoxide with a blend of $C_8$–$C_{16}$ or $C_8$–$C_{10}$alkanols.

The polyester staple fiber is preferably overcoated with about 0.03 weight percent of a secondary lubricant comprising a 70/30 weight percent mixture of butyl stearate and POE (50) sorbitol hexaoleate.

DESCRIPTION OF A SECOND PREFERRED EMBODIMENT

A second preferred embodiment of the present invention comprises polyester staple fiber which has about 0.10 weight percent of a fiber finish composition consisting essentially of (1) 40 parts by weight of a potassium salt of the alkyl phosphate esters produced by reaction of phosphorous pentoxide with a blend of $C_8$–$C_{16}$ or $C_8$–$C_{10}$ alkanols and (2) 60 parts by weight of soya dimethylethyl ammonium ethosulfate.

The polyester staple fiber is preferably overcoated with about 0.03 weight percent of a secondary lubricant comprising a 70/30 weight percent blend of butyl stearate and POE (50) sorbitol hexaoleate.

EXAMPLES

The following Examples illustrate the practice and advantages of the present invention by reference to specific embodiments of the claimed invention. In no event should the specific embodiments discussed herein be considered as limiting the scope of the generic invention disclosed in the specification.

EXPERIMENTAL PROCEDURE

A. Polyester Staple Fiber Manufacture

Polyethylene terephthalate staple fiber (1.5 inch length cut; 1.5 denier per filament) was produced according to the general procedure described above using a primary finish or one component thereof only. The primary finish or one component thereof was applied to the cooled polyester filaments as a 0.2% aqueous solution or emulsion by means of a kiss roll coater. The same primary finish or component thereof was also applied to the tow band via a pre-stretch bath of the 0.2% aqueous solution or emulsion. After stretching, the fiber tow was heat set on heated rolls, crimped and cut to a staple fiber length of 1.5 inches.

B. Fiber Finish Overspray Procedure

In order to evaluate various fiber finish compositions, 40 lb samples of the staple fiber were "oversprayed" with the desired amount of the fiber finish composition to be investigated. The overspray procedure comprises spreading forty pounds of the staple fiber to be tested evenly over plastic. The desired fiber finish composition is made up as an aqueous solution or emulsion. Half of the finish solution or emulsion is then sprayed onto the staple fiber as uniformly as possible. The staple fiber is then turned over, and the remainder of the finish solution or emulsion is uniformly sprayed over the staple fiber. The oversprayed fiber is then placed in a large, open plastic bag and allowed to dry for 10 to 12 hours.

Often, a second finish composition may be applied over the first finish composition by simply respreading the coated staple fiber onto the plastic surface, uniformly overspraying the fiber with one half of an aqueous solution or emulsion of the second finish, turning the fiber over, uniformly overspraying the fiber with the remainder of the aqueous solution or emulsion, and drying the coated fiber.

C. Chemical Analysis of Coated Fiber

A portion of the oversprayed staple fiber is analyzed to determine the approximate actual amount of the finish compounds on the fiber, and the remainder of the forty pound samples are evaluated to determine their high speed carding, drawing and open end spinning characteristics. The analysis method uses hot methanol to extract all finish compounds from the staple fiber, by means of a soxhlet extraction apparatus. This method also extracts polyester oligomers from the staple fiber, and a constant level of such oligomers (0.03 weight percent) is assumed. A primary finish level of 0.06 weight percent is also assumed; the remaining extractant is the combination of the oversprayed finish compounds. Since the proportions of these compounds are known, valid estimates of fiber finish levels can be made using this method.

D. High Speed Carding

The coated staple fibers are evaluated for their carding characteristics by feeding the sample fibers to a carding machine operated at from 50 to 55 pounds of staple fiber per hour at an average relative humidity of about 52%. As discussed above, the individual staple fibers are formed into roughly parallel strands (card slivers) which are deposited in circular fashion into a can. Three properties (static electricity, fiber cohesion, and can build-up) are qualitatively evaluated on an "acceptable/unacceptable" basis.

Any static electricity generated during high speed carding should be sufficiently low that the card web is not attracted to the metal surfaces of the carding machine ie. the area around the "trumpet" and the "take-off roll".

"Can Build" is considered acceptable when the surface of the sliver being deposited in the can is smooth. A non-smooth, "hairy" appearance due to fiber tufts sticking out of the sliver is unacceptable.

"Sliver Cohesion" between the "trumpet" and the "coiler head" should be great enough to permit the sliver to be continuously coiled without breaking.

E. Drawing

Several cans containing card sliver of the same sample fiber are creeled and simultaneously fed to a drawing frame or machine. The drawing machine consists of sets of rotating pairs of rollers through which the sliver must pass. Each subsequent set of rollers rotate at a faster speed than the preceding set, thereby drawing the sliver fibers into a more parallel relationship. The drawn sliver is then deposited in circular fashion into a can. Two drawing properties are evaluated (adhesion to the rotating rollers and can build-up) on an "acceptable/unacceptable" basis.

Drawing is considered acceptable when five or fewer breaks due to lapping on the draw frame rolls occur during twin passes with 30 lbs of sliver. Choking in the tube gears is unacceptable.

F. Open-End Spinning Evaluation

The carded and drawn sliver of oversprayed staple fibers is evaluated for open end spinning on an Ingolstadt RU 11 open end spinning machine. Six cans of sliver of the same oversprayed sample fiber are creeled and simultaneously fed to six different positions on the open end spinning machine, which is operated at a rotor speed of 50,000 rpm. The sample is evaluated on the machine for six hours, during which time the number of yarn breaks ("ends down") is recorded. The total number of breaks is then converted into the number of breaks per 1000 spindle hours. As stated above, "acceptable open end spinning" requires less than 100 "ends down" per 1000 spindle hours at a rotor speed of 50,000 rpm. Preferably, the number of "ends down" per 1,000 spindle hours at a rotor speed of 50,000 rpm is zero.

Other open end spinning characteristics are also evaluated, including staple fiber deposits on the navel surface and short broken fibers (fly) on the exterior of the rotor box. Fly is considered objectionable when enough small broken fibers accumulate at the exit port of the rotor box and contaminate the yarn being delivered to the open end spinning winder. The navel is considered acceptable when on deposit either from the finish or fiber is seen on the surface. Comber roll is acceptable when no fiber is found on the comber roll wires.

EXAMPLE 1

The purpose of this Experiment is to illustrate the concentration range of a preferred embodiment of the present invention. Following the experimental procedure summarized above, high tenacity, high modulus polyester staple fiber was produced using soya dimethyl ethyl ammonium ethosulfate ("soya") as the primary finish (0.06 weight percent on the fiber). No other finish composition was applied to the fiber prior to overspray.

Four separate samples, each comprising forty pounds of staple fiber, were individually oversprayed with varying amounts of the potassium salt of a blend of $C_8$–$C_{16}$ alkanol mono and diesters (hereinafter referred to as the "Potassium Salt"). A "control" sample was oversprayed with a secondary lubricant only. Each sample was subsequently oversprayed with the same secondary lubricant composition.

Table I recites the finish levels and experimental data for each sample:

TABLE I

| | | | | | | Open End Spinning | | | |
|---|---|---|---|---|---|---|---|---|---|
| | | | | | | Ends Down/1000 hours at 50,000 | | | |
| Sample | Primary Finish Level | | Secondary Lubricant | Carding | Drawing | rpm | Fly | Navel | Comber Roll |
| A | Soya | 0.06% | 0.03% | ok | ok | 0 | very slight | ok | ok |
| | Potassium Salt | 0.02% | | | | | | | |
| B | Soya | 0.06% | 0.03% | ok | ok | 0 | very slight | ok | ok |
| | Potassium Salt | 0.04% | | | | | | | |
| C | Soya | 0.06% | 0.03% | ok | ok | 0 | very slight | ok | ok |
| | Potassium Salt | 0.09% | | | | | | | |
| D | Soya | 0.06% | 0.03% | ok | ok | 0 | very slight | ok | ok |
| | Potassium Salt | 0.09% | | | | | | | |
| E | Soya | 0.06%[1] | 0.03% | ok | ok | 56 | moderate | failed | ok |

Legend
[1]Estimated Fiber Finish level. The actual finish value was determined to be 0.14%. However, this is believed an erroneous fiber finish level based on similar experiments.

EXAMPLE II

Evaluation of Alkyl Phosphate Ester Salts

Following the experimental procedure summarized above, high tenacity, high modulus polyester staple fiber was produced using soya dimethyl ethyl ammonium ethosulfate ("soya") as the primary finish (0.06 weight percent on the fiber). No other finish composition was applied to the fiber prior to overspray.

Eighteen separate samples, each comprising forty pounds of staple fiber, were individually oversprayed with an alkyl phosphate ester salt. Each sample was subsequently oversprayed with the same secondary lubricant composition.

Table II recites the finish levels and experimental data for each sample:

TABLE II

| | | | | | | Open End Spinning | | | |
|---|---|---|---|---|---|---|---|---|---|
| | | | | | | Ends Down/1000 hours at 50,000 | | | |
| Sample | Primary Finish Level | | Secondary Lubricant | Carding | Drawing | rpm | Fly | Navel | Comber Roll |
| A | Soya | 0.06% | 0.03% | ok | ok | 0 | slight | ok | ok |
| | Hexyl Phosphate | 0.05% | | | | | | | |
| B | Soya | 0.06% | 0.03% | ok | ok | 83 | failed | failed | ok |
| | Additional Component[1] | 0.06% | | | | | | | |
| C | Soya | 0.06% | 0.03% | ok | ok | excessive, unable to run more than a few minutes at a time | failed | NA | NA |
| | Additional Component[2] | 0.05% | | | | | | | |
| D | Soya | 0.06% | 0.03% | ok | ok | 0 | slight | ok | ok |
| | Additional Component[3] | 0.06% | | | | | | | |
| E | Soya | 0.06% | 0.03% | ok | ok | 0 | slight | ok | ok |
| | Additional Component[4] | 0.07% | | | | | | | |
| F | Soya | 0.06% | 0.03% | ok | ok | 0 | slight | ok | ok |
| | Potassium Salt | 0.06% | | | | | | | |
| G | Soya | 0.06% | 0.03% | ok | ok | 0 | slight | ok | ok |

TABLE II-continued

| Sample | Primary Finish Level | | Secondary Lubricant | Carding | Drawing | Open End Spinning Ends Down/1000 hours at 50,000 rpm | Fly | Navel | Comber Roll |
|---|---|---|---|---|---|---|---|---|---|
| | Additional Component[5] | 0.07% | | | | | | | |
| H | Soya[9] | 0.06% | 0.03% | ok | ok | 0 | slight | ok | ok |
| | Additional Component[6] | 0.06% | | | | | | | |
| I | Soya[9] | 0.06% | 0.03% | ok | ok | 0 | slight | ok | ok |
| | Potassium Salt | 0.06% | | | | | | | |
| J | Soya[9] | 0.06% | 0.03% | ok | ok | 0 | slight | ok | ok |
| | Potassium Salt | 0.06% | | | | | | | |
| K | Soya[9] | 0.06% | 0.03% | ok | ok | 28 | slight | ok | ok |
| | Potassium Salt | 0.06% | | | | | | | |
| L | Soya | 0.06% | 0.03% | ok | ok | 0 | slight | ok | ok |
| | Additional Component[7] | 0.02% | | | | | | | |
| M | Soya | 0.06% | 0.03% | ok | ok | 83 | slight | failed | ok |
| | Additional Component[5] | 0.05% | | | | | | | |
| N | Soya | 0.06% | 0.03% | ok | stoped due to chokes in tube gear | — | NA | NA | NA |
| | Ethylhexyl phosphate | 0.05% | | | | | | | |
| O | Soya | 0.06% | 0.03% | ok | ok | 28 | slight | failed | ok |
| | Additional Component[8] | 0.04% | | | | | | | |
| P | Soya | 0.06% | 0.03% | ok | stopped due to chokes in tube gear | — | NA | NA | NA |
| Q | Soya | 0.06% | 0.03% | NA | stopped due to chokes in tube gear | NA | NA | NA | NA |
| | Ethyl hexyl phosphate | 0.03% | | | | | | | |
| R | Soya | 0.06% | 0.03% | ok | ok | 0 | failed | failed | ok |

Legend

[1]Potassium salt of an polyoxyethylene decyl phosphate ester, commercially available under the trademark ETHFAC 361 from Ethox Chemicals Incorporated.

[2]Polyoxyethylene nonyl phenol phosphate, commercially available under the trademark TRYFAC 5583 from Emery Industries.

[3]Polyoxyethylene dinonyl phenol phosphate, commercially available under the trademark TRYFAC 5555 from Emery Industries.

[4]The potassium salt of the mono and diester reaction products of phosphorous pentoxide and a blend of $C_8$–$C_{12}$ alkanols commercially available under the trademark HOSTAPHAT 2176-M2 from American Hoechst Corporation.

[5]The potassium salt of the mono and diester reaction products of phosphorous pentoxide and a blend of $C_8$–$C_{10}$ alkanols, commercially available from American Hoechst Corporation under the trademark HOSTAPHAT OD.

[6]The potassium salt of the mono and diester reaction products of phosphorous pentoxide and lauryl alcohol, commercially available from Hoechst AG under the trademark LEOMIN PN.

[7]The potassium salt of the monoester reaction products of polyphosphoric acid and a blend of $C_{12}$–$C_{14}$ alkanols.

[8]The potassium salt of mono and diester reaction products of phosphorous pentoxide and $C_{20}$, commercially available from Ethox Chemicals Inc. under the trademark ETHOX 2466.

[9]Samples were discarded without performing extraction. Estimated finish levels based on analogous samples.

EXAMPLE III

Evaluation of Secondary Lubricants

Following the experimental procedure summarized above, high tenacity, high modulus polyester staple fiber was produced using soya dimethylethyl ammonium ethosulfate as the primary finish (0.06 weight percent on the fiber). No other fiber finish composition was applied to the fiber prior to overspray.

Four separate samples, each comprising forty pounds of staple fiber, were each individually oversprayed with the same potassium salt of a blend of $C_8$–$C_{16}$ alkyl phosphate esters produced by reaction of phosphorous pentoxide with a blend of $C_8$–$C_{16}$ alkanols, hereinafter referred to as the "Potassium Salt." Each sample was subsequently oversprayed with a different secondary lubricant composition.

Table III recites the finish levels and experimental data for each sample:

TABLE III

| Sample | Primary Finish Level | | Secondary Lubricant | | Carding | Drawing | Open End Spinning Ends Down/1000 hours at 50,000 rpm | Fly | Navel | Comber Roll |
|---|---|---|---|---|---|---|---|---|---|---|
| A | Soya | 0.06% | "I" | 0.03% | ok | ok | 0 | slight | ok | ok |
| | Potassium Salt | 0.07% | | | | | | | | |
| B | Soya | 0.06% | "II" | 0.03% | ok | ok | 0 | slight | ok | ok |
| | Potassium Salt | 0.05% | | | | | | | | |
| C | Soya | 0.06% | "III" | 0.03% | ok | ok | 0 | slight | ok | ok |
| | Potassium Salt | 0.07% | | | | | | | | |
| D | Soya | 0.06% | "IV" | 0.03% | ok | ok | 28 | slight | ok | ok |

TABLE III-continued

| Sample | Primary Finish Level | | Secondary Lubricant | Carding | Drawing | Open End Spinning Ends Down/1000 hours at 50,000 rpm | Fly | Navel | Comber Roll |
|---|---|---|---|---|---|---|---|---|---|
| | Potassium Salt | 0.06% | | | | | | | |

I - a 70/30 weight percent mixture of butyl stearate and an ethoxylated sorbitol ether capped with six moles of oleic acid (typically referred to as "POE (50) sorbitol hexaoleate");
II - a 69/23/8 weight percent mixture of a 50/50 blend of polyoxyethylene ethers capped with oleic acid and pelargonic acid, a blend of n-octyl adipate and n-decyl adipate, and soya dimethyl ethyl ammonium ethosulfate;
III - a 30.5/30.5/29/10 weight percent mixture of a 50/50 blend of polyoxylene ethers capped with oleic acid and pelargonic acid, a blend of n-octyl adipate and n-decyl adipate, a polyoxyethylene ether capped with oleic acid on one end and methyl on the other, and soya dimethyl ethyl ammonium ethosulfate;
IV - a 50/20/5/25 weight percent mixture of mineral oil (70 Saybolt Universal Seconds), a blend of polyoxyethylene ethers capped on one end with $C_{12}$-$C_{18}$ alkanols, oleic acid, and a 50/50 blend of polyoxyethylene ethers capped with oleic acid and pelargonic acid.

EXAMPLE IV

Evaluation of the Second Component

The purpose of this Example if to illustrate specific fiber finish compositions coming within the scope of the present invention. Throughout this example, the chemical identity and fiber finish level of the alkyl phosphate ester salt was maintained constant, and the identity and concentration of the "additional component" were varied.

High tenacity, high modulus polyethylene terephthalate staple fiber of 1.5 denier per filament was produced with a primary finish composition comprising a potassium salt of blend of $C_8$–$C_{16}$ alkyl phosphate esters produced by reaction of phosphorous pentoxide with a blend of $C_8$–$C_{16}$ alkanols, hereinafter referred to as the "potassium salt". The potassium salt was deposited on the staple fiber at 0.06 weight percent, based on the total weight of the fiber. No other finish composition was applied to the fiber prior to the overspray.

The potassium salt is commercially available from Ethox Chemicals Incorporated under the trademark ETHFAC 1358.

Eleven of the thirteen samples were also coated with a second finish component.

Twelve of the thirteen samples were subsequently oversprayed with a secondary lubricant finish composition comprising a 70/30 blend of butyl stearate (commercially available from Emery Industries under the trademark EMEREST 2326) and a POE (50) sorbitol hexaoleate (commercially available from ICI America under the trademark AHCO G1096).

Finish component weights and test data are set forth below in Table IV:

TABLE IV

| Sample | Primary Finish Level | | Secondary Lubricant | Carding | Drawing | Open End Spinning Ends Down/1000 hours at 50,000 rpm | Fly | Navel | Comber Roll |
|---|---|---|---|---|---|---|---|---|---|
| A | Potassium Salt | 0.06% | 0.03% | ok | ok | 0 | slight | ok | ok |
| | Additional Component[1] | 0.04% | | | | | | | |
| B | Potassium Salt | 0.06% | 0.03% | ok | ok | 0 | slight | ok | ok |
| | Additional Component[1] | 0.06% | | | | | | | |
| C | Potassium Salt | 0.06% | 0.03% | ok | ok | 0 | slight | ok | ok |
| | Additional Component[1] | 0.08% | | | | | | | |
| D | Potassium Salt | 0.06% | 0.03% | ok | ok | 0 | slight | ok | ok |
| E | Potassium Salt | 0.06% | — | ok | ok | 83 | slight | ok | ok |
| F | Potassium Salt | 0.06% | 0.03% | ok | stopped due to tube chokes | 0 | slight | ok | ok |
| | Additional Component[2] | 0.06% | | | | | | | |
| G | Potassium Salt | 0.06% | 0.03% | ok | ok | 0 | failed | ok | ok |
| | Additional Component[3] | 0.05% | | | | | | | |
| H | Potassium Salt | 0.06% | 0.03% | ok | many defects | 0 | slight | ok | ok |
| | Additional Component[1] | 0.05% | | | | | | | |
| I | Potassium Salt | 0.06% | 0.03% | slight defect | ok | 27 | failed | ok | ok |
| J | Potassium Salt | 0.06% | 0.03% | ok | ok | 28 | marginal | ok | ok |
| | Additional Component[4] | 0.04% | | | | | | | |
| K | Potassium Salt | 0.06% | 0.03% | ok | ok | 0 | slight | ok | failed |
| | Additional Component[4] | 0.08% | | | | | | | |
| L | Potassium Salt | 0.06% | 0.03% | ok | ok | 0 | failed | ok | ok |
| | Additional Component[5] | 0.05% | | | | | | | |
| M | Potassium Salt | 0.06% | 0.03% | ok | ok | 139 | slight | ok | failed |
| | Additional | 0.10% | | | | | | | |

TABLE IV-continued

| Sample | Primary Finish Level | Secondary Lubricant | Carding | Drawing | Open End Spinning Ends Down/1000 hours at 50,000 rpm | Fly | Navel | Comber Roll |
|---|---|---|---|---|---|---|---|---|
| | Component[5] | | | | | | | |

Legend

Additional Component 1 - soya dimethylethylene ammonium ethosulfate. Commercially available from Jordan Chemical Company under the trademark LAROSTAT 264A.

Additional Component 2 - soya dimethylethyl ammonium ethosulfate (lower molecular weight version of Larostat 264A). Commercially available from Jordan Chemical Company under the trademark LAROSTAT 143.

Additional Component 3 - Oleylimidazolene ethyl sulfate. Commercially available from Diamond Shamrock under the trademark DACOSPIN 092.

Additional Component 4 - a mixture of polyoxethylene ethers which have been reacted with a 50/50 blend of oleic and pelargonic acids. Commercially avaiable from Ethox Chemicals Inc. under the trademark ETHOX 1114.

Additional Component 5 - polyethylene gycoldioleate. Commercially available from Glyco Chemical Company under the tradename GLYCO PEGOSPERSE 600 D.O.

EXAMPLE V

Effect of Total Fiber Finish Level

Polyethylene terephthalate staple fiber having 2.25 denier per filament, a normal modulus, and a "high" tenacity-at-break was produced as follows: PET chip was melted in an extruder and forced through a multihole spinnerette, thereby forming a plurality of molten filament-like forms. These forms were immediately cooled and an aqueous solution of a two component fiber finish, described below, was applied to the filaments by a kiss roll coater. The fiber tow was stretched in a standard stretching operation employed to manufacture staple fiber. The same fiber finish was reapplied by means of a pre-stretch bath. After stretching, the fiber tow was crimped, heat set in an oven, and cut to a staple fiber length of 1.5 inches. Prior to cutting a secondary lubricant finish was applied.

The staple fiber so prepared was then evaluated for carding, drawing, and for open end spinning as described above.

The primary finish composition comprised (1) 20 weight percent of the polyether reaction product of ethylene oxide and a 50/50 mixture of oleic and pelargonic acids using a 10:1 molar excess of ethylene oxide (hereinafter referred to as "Polyether") and, and (2) 80 weight percent of the potassium salt of a blend of $C_8$–$C_{16}$ alkanol phosphate mono and diesters (hereinafter referred to as the "Potassium Salt").

The secondary lubricant composition comprised a 70/30 weight percent mixture of butyl stearate and POE (50) sorbitol hexaoleate.

EXAMPLE VI

Evaluation of Fiber Finish Composition on Staple Polyester Fibers of Varying Tenacity This Example illustrates the application of fiber finishes of the present invention to polyester staple fibers of varying tenacity-at-break and denier per filament.

Polyethylene terephthalate staple fiber having various tenacity and denier per filament was produced as follows: PET chip was melted in an extruder and forced through a multihole spinnerette, thereby forming a plurality of molten filament-like forms. These forms were immediately cooled and an aqueous solution of a two component fiber finish, described below, was applied to the filaments by a kiss roll coater. The fiber tow was stretched in a standard stretching operation employed to manufacture staple fiber. The same fiber finish was reapplied by means of a pre-stretch bath. After stretching, the fiber tow was crimped, heat set in an oven, and cut to a staple fiber length of 1.5 inches. Prior to cutting a secondary lubricant finish was applied.

In Sample I, the primary finish composition comprised (1) 40 weight percent of the potassium salt of a blend of $C_8$–$C_{16}$alkanol phosphate mono and diesters (hereinafter referred to as the "Potassium Salt") and (2) 60 weight percent of soya dimethyl ethyl ammonium ethosulfate (hereinafter referred to as "soya").

In Samples II–V, the primary finish composition comprised (1) 75 weight percent of the Potassium Salt and (2) 25 weight percent of the polyether reaction product of ethylene oxide and a 50/50 mixture of oleic and pelargonic acids using a 10:1 molar excess of ethylene oxide (hereinafter referred to as "Polyether").

In all five samples, the secondary lubricant composition comprised a 70/30 weight percent mixture of butyl stearate and POE (50) sorbitol hexaoleate.

The staple fiber so prepared was then evaluated for carding, drawing and for open end spinning as described above.

TABLE V

| Sample | Primary Finish Level | | | Secondary Lubricant | Carding | Drawing | Open End Spinning Ends Down/1000 Spindle hours at 50,000 rpm | Fly | Navel | Comber Roll |
|---|---|---|---|---|---|---|---|---|---|---|
| A | Potassium Salt | 80% | 0.09% | 0.08% | ok | ok | 104 | NA | failed | NA |
| | Polyether | 20% | | | | | | | | |
| B | Potassium Salt | 80% | 0.09% | 0.08% | ok | ok | 788 | NA | failed | NA |
| | Polyether | 20% | | | | | | | | |

TABLE IV

| Sample | Primary Finish Level | | Secondary Lubricant | Carding | Drawing | Ends Down/1000 Spindle hours at 50,000 rpm | Open End Spinning Fly | Navel | Comber Roll |
|---|---|---|---|---|---|---|---|---|---|
| "I" | Soya | 0.06% | 0.04% | ok | ok | 0 | slight | ok | ok |
| | Potassium Salt | 0.04% | | | | | | | |
| "II" | Potassium Salt | 0.075% | 0.04% | ok | ok | 0 | very slight | ok | ok |
| | Polyether | 0.025% | | | | | | | |
| "III" | Potassium Salt | 0.075% | 0.03% | ok | ok | 0 | slight | ok | ok |
| | Polyether | 0.025% | | | | | | | |
| "IV" | Potassium Salt | 0.075% | 0.05% | ok | ok | 0 | slight | ok | ok |
| | Polyether | 0.025% | | | | | | | |
| "V" | Potassium Salt | 0.075% | 0.04% | ok | ok | 0 | very slight | ok | ok |
| | Polyether | 0.025% | | | | | | | |

Legend
I - Normal tenacity, normal modulus, disperse dyeable, semi-dull, optically white,1.5 denier per filament
II - Normal tenacity, normal modulus, disperse dyeable, semi-dull, optically white, 1.2 denier per filament
III - Normal tenacity, normal modulus, disperse dyeable, semi-dull, optically white, 2.25 denier per filament
IV - Normal tenacity, normal modulus, disperse dyeable, semi-dull, optically white, 1.5 denier per filament
V - Low tenacity, normal modulus, disperse dyeable, semi-dull, low pilling, 2.5 denier per filament

We claim:

1. A synthetic staple fiber, adapted for open end spinning having a finish thereon comprising:

(a) from about 0.08 to about 0.15 percent of a primary finish comprising (i) from 25 to 85 weight percent of at least one alkyl phosphate ester salt; and (ii) from 15 to 75 weight percent of a second component selected from the group consisting of quaternary trialkyl ethyl ammonium ethosulfate salts and the reaction products of polyoxyethylene ethers and $C_8$–$C_{22}$ fatty acids, and (b) from 0.01 to 0.06 weight percent of a secondary lubricant, with the proviso that said staple fibers possess an "ends down"/1000 spindle hours of open end spinning at a rotor speed of 50,000 rpm of 100 or less.

2. The synthetic staple fiber of claim 1 wherein said secondary lubricant comprises a 70/30 weight percent mixture of butyl stearate and an ethoxylated sorbitol ether capped with six moles of oleic acid.

3. The synthetic staple fiber of claim 1 wherein said secondary lubricant comprises a 69/23/8 weight percent mixture of a 50/50 blend of polyoxyethylene ethers capped with oleic acid and pelargonic acid, a blend of n-octyl adipate and n-decyl adipate, and soya dimethyl ethyl ammonium ethosulfate.

4. The synthetic staple fiber of claim 1 wherein said secondary lubricant comprises a 30.5/30.5/29/10 weight percent mixture of a 50/50 blend of polyoxyethylene ethers capped with oleic acid and pelargonic acid, a blend of n-octyl adipate and n-decyl adipate, a polyoxyethylene ether capped with oleic acid on one end and methyl on the other, and soya dimethyl ethyl ammonium ethosulfate.

5. The synthetic staple fiber of claim 1 wherein said secondary lubricant comprises a 50/20/5/20 weight percent mixture of mineral oil, a blend of polyoxyethylene ethers capped on one end with a blend of $C_{12}$–$C_{18}$ alkanols, oleic acid, and a 50/50 blend of polyoxyethylene ethers capped with oleic acid and pelargonic acid.

6. A polyester staple fiber, adapted for open end spinning, having a tenacity-at-break of from 3.0 to 7.0 grams-force/denier and a modulus of from 12 to 50 grams-force/denier additionally having a finish thereon comprising:

(a) from about 0.08 to about 0.15 percent percent of a primary finish comprising (i) from 25 to 85 weight percent of at least one alkyl phosphate ester salt; and (ii) from 25 to 85 weight percent of second component selected from the group consisting of quaternary trialkyl ethyl ammonium ethosulfate salts and the reaction products of polyoxyethylene ethers and $C_8$–$C_{22}$ fatty acids, (b) from 0.01 to 0.06 weight percent of a secondary lubricant, with the proviso that said staple fiber possess an "ends down"/1000 spindle hours of open end spinning at a rotor speed of 50,000 rpm of 100 or less.

7. The polyester staple fiber of claim 6 wherein said tenacity-at-break ranges from 3.0 to 5.0 gram-force/denier and said "ends down"/1000 hours of open end spinning is 50 or less.

8. The polyester staple fiber of claim 7 wherein said secondary lubricant comprises a 70/30 weight percent mixture of butyl stearate and an ethoxylated sorbitol ether capped with six moles of oleic acid.

9. The polyester staple fiber of claim 7 wherein said secondary lubricant comprises a 69/23/8 weight percent mixture of a 50/50 blend of polyoxyethylene ethers capped with oleic acid and pelargonic acid, a blend of n-octyl adipate and n-decyl adipate, and soya dimethyl ethyl ammonium ethosulfate.

10. The polyester staple fiber of claim 7 wherein said secondary lubricant comprises a 30.5/30.5/29/10 weight percent mixture of a 50/50 blend of polyoxyethylene ethers capped with oleic acid and pelargonic acid, a blend of n-octyl adipate and n-decyl adipate, a polyoxyethylene ether capped with oleic acid on one end and methyl on the other, and soya dimethyl ethyl ammonium ethosulfate.

11. The polyester staple fiber of claim 7 wherein said secondary lubricant comprises a 50/20/5/20 weight percent mixture of mineral oil, a blend of polyoxyethylene ethers capped on one end with $C_{12}$–$C_{18}$ alkanols, oleic acid, and a 50/50 blend of polyoxyethylene ethers capped with oleic acid and pelargonic acid.

12. A polyester staple fiber, adapted for open end spinning, having a tenacity-at-break of from 3.0 to 7.0 grams-force/denier and a modulus of from 12 to 50 grams-force/denier additionally having a finish thereon comprising:

(a) from about 0.08 to about 0.15 percent of a primary finish consisting essentially of (i) from 25 to 85 weight percent of at least one alkyl phosphate ester salt; and (ii) from 25 to 85 weight percent of second component selected from the group consisting of quaternary trialkyl ethyl ammonium ethosulfate salts and the reaction products of polyoxyethylene ethers and $C_8$–$C_{22}$ fatty acids, (b) from 0.01 to 0.06 weight percent of a secondary lubricant, with the proviso that said staple fiber possess and "ends down"/1000 spindle hours of open end spinning at a rotor speed of 50,000 rpm of 100 or less.

* * * * *